United States Patent [19]

Fielding et al.

[11] 4,441,772

[45] Apr. 10, 1984

[54] SEPARABLE BOTTOM MOUNTED DRAWER SLIDE

[75] Inventors: Brian S. Fielding, Chappaqua; Fred S. Leiper, Valley Cottage, both of N.Y.

[73] Assignee: Hardware Designers, Inc., Mt. Kisco, N.Y.

[21] Appl. No.: 347,884

[22] Filed: Feb. 11, 1982

[51] Int. Cl.[3] ..... A47B 88/16

[52] U.S. Cl. ..... 312/330 R; 312/333; 312/348

[58] Field of Search ..... 312/330 R, 333, 337, 312/348, 339, 340

[56] References Cited

U.S. PATENT DOCUMENTS

| | | | |
|---|---|---|---|
| 2,486,764 | 11/1949 | Singer | 312/348 |
| 3,123,419 | 3/1964 | Maxwell | 312/339 |
| 3,371,968 | 3/1968 | Loake | 312/348 |
| 3,462,203 | 8/1969 | Del Vecchi | 312/348 |
| 4,065,196 | 12/1977 | Stein | 312/333 |

*Primary Examiner*—Victor N. Sakran

*Attorney, Agent, or Firm*—Mark T. Basseches; Paula T. Basseches

[57] ABSTRACT

The present invention is directed to a bottom mounted drawer slide for supporting a drawer in a cabinet. The device is characterized in that the slide assembly is provided with means for enabling the drawer to be removed and to be replaced with a minimum of manipulative effort. The slide assembly incorporates fail-safe features which assure that the assembly latching the drawer channel to the stationary channel is automatically shifted to locked position responsive to assembly of the channels and is always in a position locked against accidental removal when the channels reach their mutually extended positions.

7 Claims, 7 Drawing Figures

SEPARABLE BOTTOM MOUNTED DRAWER SLIDE

BACKGROUND OF THE INVENTION

1. Field of the Invention

The present invention is in the field of drawer slide assemblies and relates more particularly to a bottom mounted drawer slide assembly, i.e. an assembly in which a fixed or cabinet channel is secured beneath a drawer opening and a movable or drawer channel is secured to the bottom of a drawer thereby, movably mounted in the opening.

2. The Prior Art

It is known to provide bottom mounted drawer slide assemblies in situations particularly where the drawer load is relatively small. Known constructions of the type described have typically included an internesting pair of channel members having antifriction means interposed therebetween. Certain constructions of the type described enable the drawer and its associated channel to be physically removed from the cabinet channel. The mechanism by which removal has been effected has heretofore included a frictional blocking mechanism whereby at the outward limiting position of the drawer the slide member will not move further outwardly unless the drawer is subjected to a pulling force substantially in excess of the force needed for sliding the drawer.

Such friction release slide assemblies are disadvantageous. Firstly, if the forces required to decouble such devices are insubstantial, it is possible by forcefully pulling a drawer outwardly inadvertently to overcome the frictional resistance to separation. In such event the rear end of the drawer will fall downwardly, dumping the contents of the drawer, with resultant disarray of the contents of possibly injury to the user. Conversely, if the frictional forces required for disengagement are unduly greater, it is even possible to damage the fastening connections between slide and drawer in the act of removing the drawer. If, in opening the drawer, the frictional connection between the drawer channel and bearing housing is partially decoupled, the drawer will not close completely with application of normal closing forces and the user will assume that the drawer is "stuck."

SUMMARY OF THE INVENTION

The present invention is directed to a bottom mounted drawer slide assembly characterized in the provision of a novel lock mechanism which, in the fully extended position of the drawer channel relative to the cabinet channel may be manipulated smoothly to release the drawer for removal. The release mechanism is located adjacent the innermost edge of the drawer and, thus, the user must necessarily having his hand disposed in a supporting position of the rear end of the drawer, precluding inadvertent overturning of the drawer.

The latch assembly includes a novel pawl and stop mechanism whereby the latch is positively shifted to a drawer locking position when it reaches its fully extended position whereby the drawer slide is dependably locked against further outward movement unless the position of the pawl is manually shifted.

The latch mechanism is further characterized in that the pawl is automatically opened responsive to initial reinserting movements of the drawer into the cabinet and automatically closed responsive to further inserting movements, guarding against the possibility that the pawl may remain in its unlocked position with the result that the drawer could inadvertently be pulled clear of the cabinet during a subsequent operating cycle.

The various operations of the locking pawl are effected without reliance upon springs or gravitational forces.

Accordingly, it is an object of the invention to provide an improved bottom mounted drawer assembly characterized in that the same includes a latch mechanism which may be readily released to permit the drawer to be removed from the cabinent without the exercise of significant pulling forces.

It is a further object of the invention to provide an assembly of the type described wherein the latch mechanism is automatically shifted to its drawer latching position responsive to outward movements of the drawer.

It is still a further object of the invention to provide a slide assembly of the type described wherein the latch mechanism is automatically opened responsive to initial assembly movements of the slides and is automatically shifted to latching position responsive to further inward movements of the drawer slide.

It is a further object of the invention to provide a drawer slide assembly having a positive out stop whereby, for the first time, it is possible in a bottom mounted slide construction to meet furniture manufacturer's specifications which call for such positive control.

To attain these objects and such further objects as may appear herein or be hereinafter pointed out, reference is made to the accompanying drawings, forming a part hereof, in which.

Figure 1:
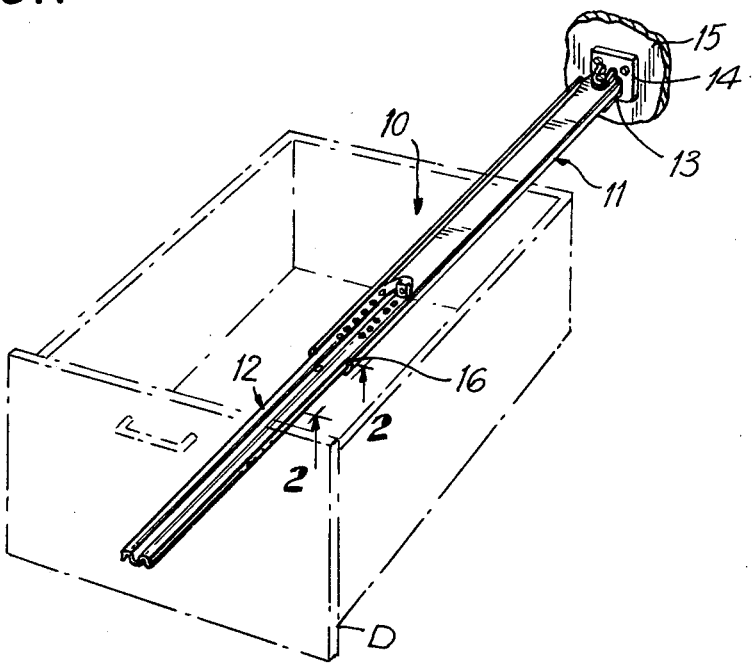
FIG. 1 is a perspective view of a slide assembly in accordance with the invention shown in conjunction with a drawer member, the drawer being illustrated in phantom.

Turning now to the drawings, there is disclosed in FIG. 1 a slide assembly 10 comprised of a fixed or cabinet mounted channel 11 and a moving or drawer mounted channel 12. The rear or inner end 13 of the cabinet mounted channel is fixed to a bracket 14 secured to a portion of the shell or cabinet 15 within which the drawer is mounted.

The foward end 16 of channel 11 is fastened to a portion of the cabinet (illustration of which has been omitted for purposes of clarity) so as to support channel 11 in a horizontal orientation. The drawer channel 12 is secured in any desired manner beneath drawer D.

Figure 4:
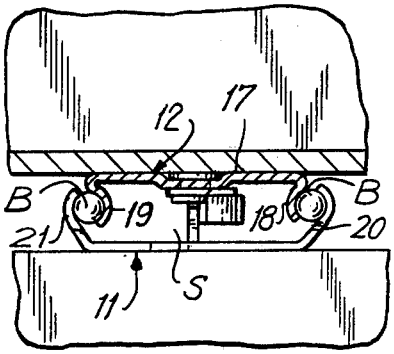
FIG. 4 is a transverse section taken on the line 4—4 of FIG. 2.

As best seen from FIG. 4, the cabinet channel 11 is generally U-shaped in section and the drawer channel 12 is generally in the form of an inverted U, including a central web 17 and depending legs 18, 19.

The cabinet channel includes upwardly directed legs 20, 21, the respective legs 18 and 20 and 19 and 21 being so configured as to support therebetween antifriction means, such as balls B mounted in ball retainers (not shown). As will be understood, the balls act to permit the channels 11 and 12 freely to slide relative to each other.

The construction of the channels and the manner of their interconnection to permit translatory movement of the drawer is known per se and form no part of the present invention. Accordingly, further discussion thereof will not be undertaken.

The principal advance of the present invention is directed to the latch assembly which is comprised generally of a pawl member 22 mounted to the web 17 of the drawer channel 12 and stop member 23 formed from the body of the cabinet channel 11.

Stop member 23 is preferably comprised of a dart or stud struck from the body of the cabinet channel and extending upwardly into the space S defined between the nested channels. The stop 23 includes an inner or latch retaining face 24 and an outer or pawl tripping face 25. The pawl 22 is pivotally mounted, as by rivet member 26 passing through the aperture 27 in the pawl 22, and secured into the web 17. Preferably, the pivotal connection is effected in a manner in which a drag or frictional restraint is imparted to the pawl.

The pawl 22, adjacent its inner end 28, is provided with a first cam surface 29 extending in a vertical plane inclined relative to the axis of the channels, the cam surface 29 including a latch surface 30 at the trailing or outer end thereof.

The pawl 22, to the opposite side of rivet 26, includes a second vertical cam surface 31 inclined generally in the same direction as the first cam surface 29, and a third vertical cam surface 32 inclined in a direction opposite to the direction of the surface 31.

The pawl 22 may include a flat trip surface 33 which is manually actuable to shift the pawl to the release position, as will be hereinafter described.

The operation of the device will be evident from the preceding description.

Figure 2:
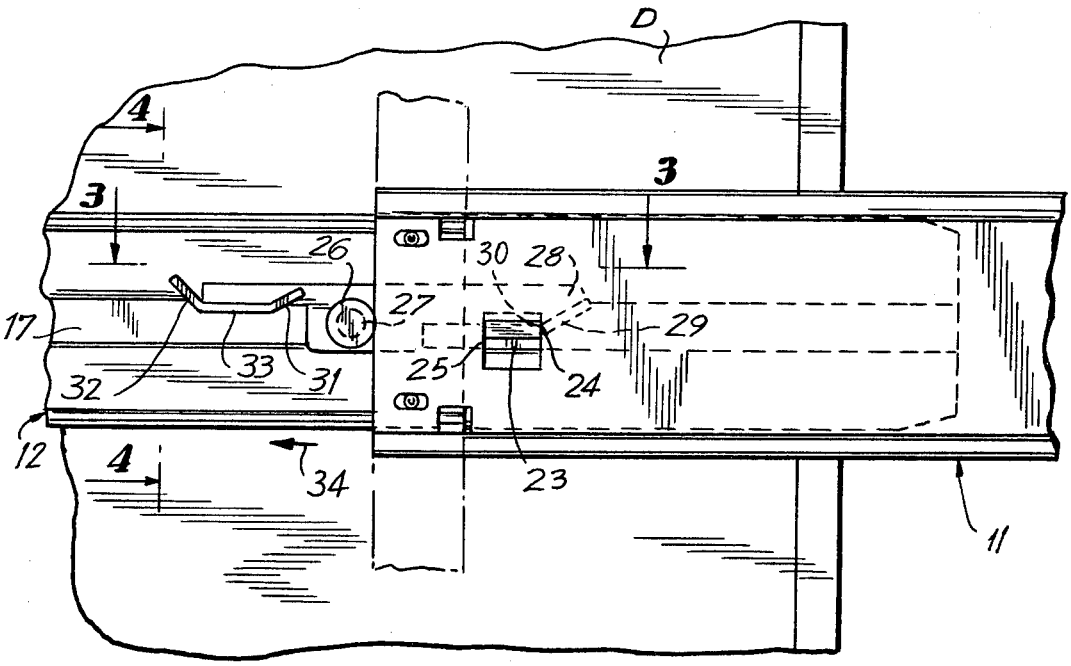
FIG. 2 is a magnified fragmentary bottom plan view of the latch components of the slide assembly.
Figure 3:
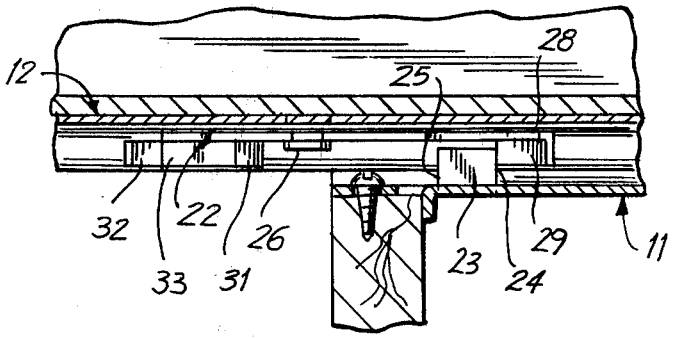
FIG. 3 is a section taken on the line 3—3 of FIG. 2.
Figure 5:
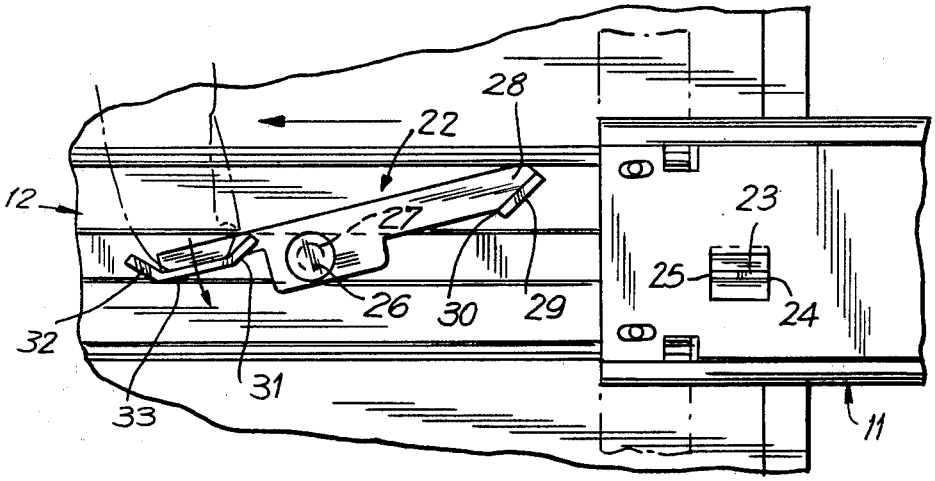
FIG. 5 is a bottom plan view illustrating the position of the parts when the latch mechanism has been tripped to the removing position of the drawer.
Figure 6:
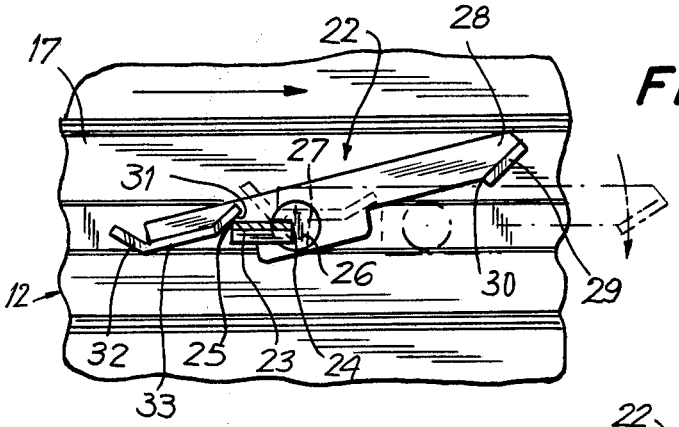
FIG. 6 is a fragmentary view showing two positions of the latch parts during initial return movements of the drawer channel into the cabinet channel.
Figure 7:
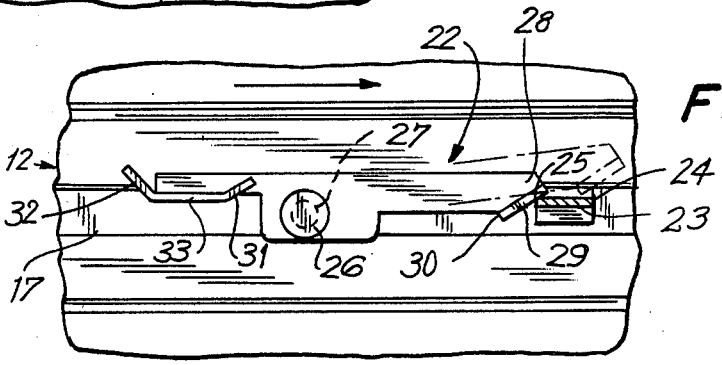
FIG. 7 is a fragmentary view showing the latch parts in two further assembled positions of the drawer channel into the cabinet channel.

The pawl 22 is shiftable between a first limiting position shown in FIGS. 2 and 7 (solid lines) wherein the pawl is generally aligned with the longitudinal axes of the channels and a second limiting position shown in FIGS. 5 and 6 (solid lines) wherein the pawl is inclined relative to the axes of the channels.

As will be seen from FIG. 2, for example, when the pawl is in the first limiting position and the drawer is pulled outwardly to its fully extended position, i.e. in the direction of the arrow 34, FIG. 2, the latch surface 30 of the pawl will lie behind the inner surface 24 of the stop 23 and block further outward movement of the drawer.

It is important to note that if, by some mischance, in the course of such outward movement the pawl 22 should lie in the second limiting or release position, the third cam surface 32 would, under such circumstances, be disposed in the path of the latch retaining face 24 of the stop member and would necessarily pivot the pawl to the first limiting position shown in FIGS. 2 and 7 (solid lines), whereby the latch surface 30 would engage against the inner surface 24 of the stop 23.

With the parts positioned as shown in FIG. 2, it will be observed that no further outward movement of the drawer is possible.

Should it be desired to remove the drawer, it is merely necessary manually to tilt the pawl to its second limiting position, shown in FIG. 5, by lateral pressure against the surface 33 whereby the latch surface 30 is cleared from the surface 24 of the stop 23, enabling the drawer to be removed.

When it is desired to reassemble the drawer to the cabinet, i.e. to reinsert the drawer channel 12 into the cabinet channel 11, the pawl is automatically actuated to ensure that the same will be shifted to an unlocking position until the latch face 30 passes the stop 23, and thereafter to the latching or first limiting position as the drawer is shifted further inwardly to its mounted position.

In progressively moving inwardly relative to the cabinet channel, it is immaterial whether, upon insertion, the pawl 22 is in its first or second limiting position. By way of example, if the pawl is in the first limiting or normally locked position, upon initial reinsertion the outer face 25 of stop 23 will engage against first cam surface 29 and cant the pawl in anticlockwise direction (see FIG. 6), thus removing the latch surface 30 from a position in front of the stop member 24, permitting further inward movement of the drawer channel into the cabinet channel.

Of course, if the pawl is already in its second limiting position during initial reassembling movements, no camming action between surfaces 29 and 25 will be experienced or necessary.

The components are shown in a further inserted position in FIG. 6 where it will be apparent that the outer surface 25 of stop 23 will, by reason of the tilted position of the pawl, engage against second cam surface 31, with the result that the pawl will be shifted from the second limiting or release portion thereof to the first limiting or latching position thereof, whereby the latch surface 30 will be returned to an orientation which is in the path of inner surface 24 of the stop member 23 (see dot and dash position, FIG. 6).

It will be readily recognized that the pawl will thus again function to prevent removal of the drawer unless the same is manually tilted to the second limiting position described.

As will be apparent from the preceding description, it is the function of the third cam surface 32 to assure that the pawl is in its first limiting or latching position when the drawer is withdrawn. The importance of such function resides in the fact that the pawl conceivably could be jarred from the first limiting or latched position to which it is automatically returned upon reassembly of the drawer to the second limiting or release position by jostling of the drawer, i.e. in the course of shipment of furniture incorporating the slide assembly. In such event, cam 32 positively assures the latching action on each cycle of withdrawal of the drawer notwithstanding the initial position of the pawl.

It is the function of cam surface 29 to open the pawl to its second limiting position upon reinsertion of the drawer channel into the cabinet channel to assure that a smooth reentry of the channels is achieved notwithstanding the position of the pawl when the drawer is returned to the cabinet.

It is the function of second cam surface 31 to return the pawl 22 to its first limiting or latched position during early stages of reassembly of the drawer.

From the foregoing it will be recognized that there is described in accordance with the invention a bottom mounted drawer slide assembly wherein the drawer may be readily removed from the cabinet but which removal procedure can be accomplished only after manual tripping of the pawl.

The cam surfaces co-act with the stop member to assure that the pawl in all instances is disposed in an operative position wherein smooth assembly of the channels is effected during initial stages of remounting of the drawer and the pawl is shifted to latching position responsive to subsequent remounting movements.

Operation of the pawl is independent of gravity or spring means or like mechanisms which are liable to failure in time.

The pawl mechanism is encompassed between the channel sections in all but the fully extended position of the drawer whereby it is shielded against ingress of detritus and the like but is exposed to manual actuation when the drawer reaches its fully extended position.

As will be obvious to those skilled in the art and apprised of the instant disclosure, numerous variations in detail of the illustrated embodiment may be made without departing from the spirit of the invention. Accordingly, the invention is to be broadly construed within the scope of the appended claims.

Having thus described the invention and illustrated its use, what is claimed as new and is desired to be secured by Letters Patent is:

1. A frontwise removable bottom mounted drawer slide assembly comprising a fixed channel adapted to be mounted to a cabinet and a movable drawer channel adapted to be mounted to a drawer, antifriction means interposed between said channels and connecting said channels for longitudinal relative movement between telescoped and extended positions, said drawer channel having an outer end portion adapted to be disposed adjacent the face of a drawer and an inner end portion endwisely removable from said cabinet channel in said extended position, a self-coupling lock mechanism for connecting and disconnecting said channels, said mechanism including a stop member on said fixed channel, a pawl on said drawer channel having a first end adjacent said inner end of said drawer channel and an outer end spaced from said inner end, said pawl being mounted for pivotal movement about an axis intermediate said ends between first and second limiting positions, a latch surface on said pawl adjacent said inner end, said latch surface facing said outer end and being in the path of said stop member and clear of said stop member in said first and second positions respectively of said pawl, first cam means on said pawl inwardly positioned relative to said latch surface and disposed in the path of said stop member for co-acting with said stop member to shift said pawl from said first to said second position responsive to inward movement of said first cam past said stop member and second cam means on said pawl outwardly of said pivot for shifting said pawl from said second to said first position responsive to continued inward movement of said drawer channel relative to said cabinet channel.

2. A slide assembly in accordance with claim 1 wherein said pawl includes a third cam surface outwardly located with respect to said second cam surface, said third cam surface being disposed in the path of said stop member in said second position of said pawl and inclined to shift said pawl from said second to said first limiting position responsive to outward movement of said drawer channel relative to said fixed channel.

3. A slide assembly in accordance with claim 2 wherein said pawl includes a manually operable trip surface on the portions of said pawl outwardly of said pivot.

4. A slide assembly in accordance with claim 3 wherein said drawer channel is in the configuration of an inverted U, and includes a central web and depending legs, and said pawl is mounted on said web and is pivotal about a vertical axis.

5. A drawer slide construction comprising a stationary cabinet channel, a drawer channel slidably connected to said cabinet channel, lock means interposed between said channels for preventing inadvertent endwise separation of said channels, said lock means including a stop member on said cabinet channel, a pawl pivotally connected on said drawer channel, a latch surface on said pawl, said pawl being shiftable between first and second limiting positions respectively wherein said latch surface is in the path of and clear of said stop member, a first cam surface means on said pawl inclined to shift said pawl from said first to said second position responsive to partial inward movement of said drawer channel relative to said cabinet channel, second cam surface means on said pawl inclined to shift said pawl from said second to said first position responsive to further inward movement of said latch surface to a position whereat said latch surface is disposed inwardly beyond said stop member, and third cam means on said pawl inclined to shift said pawl from said second to said first position responsive to outward movement of said drawer channel relative to said cabinet channel.

6. A slide construction in accordance with claim 5 wherein said first, second and third cam means are positioned to co-act with said stop member to effect said movements of said pawl between said limiting positions.

7. A slide construction in accordance with claim 6 wherein said channels comprise telescoping U sections, and said pawl is contained between said sections in all but the retracted position of said drawer.

* * * * *